United States Patent [19]

Meszaros

[11] Patent Number: 5,030,248

[45] Date of Patent: Jul. 9, 1991

[54] DYEING METHOD

[75] Inventor: Laszlo A. Meszaros, Charlotte, N.C.

[73] Assignee: Sandoz Ltd., Basle, Switzerland

[21] Appl. No.: 394,461

[22] Filed: Aug. 16, 1989

Related U.S. Application Data

[63] Continuation-in-part of Ser. No. 238,948, Aug. 31, 1988, abandoned.

[51] Int. Cl.[5] ..... C09B 49/00

[52] U.S. Cl. ..... 8/652; 8/561; 8/650; 8/651; 8/918

[58] Field of Search ..... 8/561, 652, 918

[56] References Cited

U.S. PATENT DOCUMENTS 4,252,533 2/1981 Heid et al. ..... 8/587
4,801,303 1/1989 Carlough et al. ..... 8/652

FOREIGN PATENT DOCUMENTS 7161176 12/1982 Japan .
2201165 8/1988 United Kingdom .

OTHER PUBLICATIONS

Journal of the Society of Dyers and Colourists, vol. 103, Sep. 1987, pp. 297–298.

*Primary Examiner*—Paul Lieberman
*Assistant Examiner*—J. E. Darland
*Attorney, Agent, or Firm*—Gerald D. Sharkin; Richard E. Vila; Thomas C. Doyle

[57] ABSTRACT

Cellulosic substrates are dyed by a continuous dyeing method with dispersed sulfur dyes using a reducing sugar, especially glucose, as the reducing agent for the dye.

26 Claims, No Drawings

DYEING METHOD

This is a continuation-in-part of copending application Serial No. 07/238,948, filed Aug. 31, 1988, now abandoned.

This invention relates to an improved method for dyeing or printing cellulosic substrates with sulfur dyes.

More particularly, the invention relates to the continuous dyeing or printing of cellulosic substrates with dispersed sulfur dyes.

According to the present invention, a substrate comprising cellulosic fibers is dyed or printed by continuously applying thereto an aqueous dispersion of a sulfur dye and either simultaneously or subsequently applying a reducing sugar together with alkali and then subjecting the thus-treated substrate to sufficient heat to effect reduction of the sulfur dye on the substrate.

The substrate to be dyed or printed according to this invention may be any substrate containing cellulosic fibers. The substrate may be in any form, e.g. yarn, woven or knitted fabric. It may comprise only cellulosic fibers or a blend of cellulosic fibers with synthetic fibers such as polyamide, polyester or polyacrylonitrile. The preferred cellulosic material is cotton. More preferably, the substrate comprises cotton alone or blended with polyester.

Preferably, dyeing is carried out using the pad-steam or pad-dry-pad-steam method. According to the pad-steam method, an aqueous dyeing liquor containing the sulfur dye, reducing sugar and alkali is applied at a temperature at which the sulfur dye will remain in the oxidized state, preferably in the range 20 to 60° C., more preferably 25 to 50° C. Typically, it is padded onto the substrate to a wet pick-up of about 55 to 70% based on the weight of the substrate. After the dyeing liquor has been applied thereto, the substrate is heated to a temperature sufficiently high to effect reduction of the dye, usually 98 to 105° C., preferably 100 to 103° C. According to the pad-dry-pad-steam method, dyeing liquor containing the sulfur dye is applied by padding the substrate, typically, to a wet pick-up of 55 to 70% at a temperature of 20 to 75° C., preferably 30 to 65° C., the substrate is dried, then padded with a solution of a reducing sugar in aqueous alkali, preferably to a wet pick-up of 90 to 120% and then heated, as above, to effect reduction of the dye. Printing may be effected in a manner similar to the pad-dry-pad-steam method, printing the substrate with a printing paste instead of padding it with a dye liquor.

Where the substrate is a cellulose-polyester blend, the pad-dry-thermosol-pad-steam method is preferably employed. A suitable disperse dye is included with the sulfur dye in the dye liquor and a thermosol treatment is carried out after the drying step. Otherwise, this method is similar to the pad-dry-pad-steam method.

As indicated above, heating is preferably effected with steam, more preferably in the non-pressurized steamer of a conventional padder steamer wherein the substrate is under only a slightly elevated pressure as is sufficient to prevent air from entering the steamer, usually up to about 1.15 atmospheres. Heating should be carried out for a time which is long enough to effect complete reduction of the dye on the substrate at the temperature employed but short enough to accommodate continuous operation in the particular equipment employed. Preferably, the heating time is about 20 to 110 seconds, more preferably 40 to 110 seconds, most preferably 40 to 75 seconds.

Dyeing may be effected using conventional continuous dyeing equipment. As will be understood by those skilled in the art, such conventional equipment comprises means such as one or more padders, for continuously applying a dyeing liquor and a reducing agent to the substrate and a non-pressurized zone, e.g. a steamer, in which the thus-treated substrate is subsequently heated to reduce the dye. Similarly, printing may be carried out using conventional printing equipment together with a non-pressurized steamer, preferably one that is particularly designed for steaming of prints and wherein the printed portion of the substrate is not contacted by rollers. It is a feature of the present invention that it makes possible combining the advantages of using an environmentally safe reducing sugar and conventional equipment.

Following the application of the dyeing liquor or printing paste to the substrate and the heating step, it is usually advantageous to subject the thus-treated substrate to an oxidation step to further improve the fastness of the dyeing or printing. While some dyeings and printings may become sufficiently oxidized by a water-rinsing step which is normally carried out after dyeing, it is preferred to effect a chemical oxidation. For this purpose there may be used hydrogen peroxide or a catalyzed sodium bromate system. The oxidation conditions are conventional and will vary somewhat depending on the particular equipment and the speed at which the substrate is moving. In general, with sodium bromate catalyzed with vanadium pentoxide the amount of this oxidizing agent is usually 3.75 to 11.25 g/1, the pH is preferably 3–4.5 and the temperature is about 49–82° C., preferably about 60–75° C., and with hydrogen peroxide about 1 to 5 g/1 of this compound are used at pH 5–7.5, preferably 5.5–6, and 35–60° C. Acetic or formic acid is usually employed with both systems to give the desired pH. The substrate is subjected to the action of an oxidizing-effective amount of the aqueous oxidizing liquor for about 5 to 70 seconds, more usually about 10 to 40 seconds.

The dyeing liquor is preferably prepared by mixing a previously prepared aqueous sulfur dye dispersion with additional water and, where the pad-steam method is to be used, with a reducing sugar and alkali.

As the reducing sugar, there may be used any of those carbohydrates or combinations thereof which reduce Fehling solution, e.g. aldopentoses, such as L-arabinose, D-ribose, and D-xylose, hexoses, such as D-glucose, D-fructose, D-mannose and D-galactose, and disaccharides, such as cellobiose, lactose and maltose. Products such as corn syrup, invert sugar and molasses, which contain reducing sugar, may also be used, as may dextrose prepared in situ from sucrose. The preferred reducing sugar is D-glucose.

The amount of reducing sugar should be sufficient to reduce the sulfur dye when the dye liquor-treated or printed substrate is heated as described above. Preferably, the reducing sugar is used in an amount of 30 to 135 grams per liter, more preferably 50 to 120 grams/liter, regardless of whether it is applied from the dye liquor or separately from an aqueous alkaline solution. Larger amounts may be used, but generally they will not improve the quality of the dyeing. Preferably, the reducing sugar is the sole reducing agent added to the sulfur dye liquor or to the aqueous alkaline solution.

The alkali may be any of those known to be useful in the reduction of sulfur dyes, particularly sodium or potassium hydroxide or carbonate, more particularly sodium hydroxide. The alkali is preferably employed in an amount of about 8 to 70 grams, more preferably 10 to 50 grams per liter of the dyeing liquor or of the separately applied reducing sugar-containing aqueous liquor, so as to give a pH of at least 10, preferably at least 10.5.

The dyeing liquor may also contain a wetting agent to improve the penetration of the liquor into the substrate during application. The particular wetting agent is not critical. Anionic compounds are preferred, such as the sodium salt of phosphated 2-ethylhexanol. Typical amounts of wetting agent are in the range 1 to 15 grams per liter of dyeing liquor.

The aqueous dyeing liquor for use in the pad-dry-pad-steam method preferably contains an agent to inhibit migration of the dye during the drying step. Such products are known and may be either synthetic, e.g. based on polyacrylate, or preferably natural, e.g. based on alginates.

Where the dye is to be applied by printing, conventional thickeners are employed to produce a printing paste having the desired properties.

The aqueous sulfur dye dispersion used in making the dyeing liquor or printing paste is suitably a mixture of an oxidized sulfur dye in water containing a sufficient amount of dispersing agent to effect dispersion of the dye in the water. It is convenient to start with a presscake of the oxidized sulfur dye as obtained by conventional thionation, dilution of the thionation mass with water, oxidation, filtration and washing of the filter cake.

The oxidation (aeration) is preferably carried out until the reaction mixture is free of inorganic sulfides. This point is indicated when the reduction equivalent of the reaction mixture is zero, as may be determined by potentiometric titration with 0.2 N cupric ammonium sulfate solution.

It has been found that with some dyes it is preferable to lower the polysulfur content in order to improve their dispersibility. By "polysulfur content" is meant the amount of sulfur that is covalently and linearly linked between the chromophore and the thiol groups of the dyestuff. Aeration of the dye to a reduction equivalent of zero may also serve to lower the polysulfur content to the desired level. It is advisable to carry out a trial aeration to zero reduction potential and then test the product for polysulfur content. This can be done by treating a sample of the product with excess sodium sulfide followed by calorimetric titration of the sample with sodium cyanide. If the polysulfur content, as determined by this method, is found to be greater than 7% by weight, based on the dry weight of the dye, preferably if it is found to be greater than 3%, then the method of precipitating that particular dye is preferably modified to include treatment with a polysulfur-lowering-effective amount of sodium sulfite and/ or sodium nitrite prior to the aeration. The preferred polysulfur content will vary for each dyestuff and is that amount which provides good dispersibility coupled with good reducibility during the steaming step. Generally, it is in the range 0 to 3%, based on the dry weight of the dye, and can be determined by routine testing.

Preferably, the aeration is discontinued as soon as possible after the sulfides have been eliminated. It has been found that overoxidation can lead to the formation of crosslinked polycondensation products which are not readily reducible by glucose-caustic and which are, therefore, not desirable in the dyeing and printing processes of this invention. It is convenient to monitor the particle size of the suspension, e.g. with a particle size analyzer, and to discontinue aeration before an increase in particle size begins to occur.

Preferably, the presscake is washed to remove inorganic salts which are usually associated with such thionation reaction products. The washing is suitably carried out until the inorganic sulfate content, based on the weight of solids in the presscake, is less than 2%, preferably less than 0.6%, by weight. More preferably, the washing is carried out until the content of all inorganic salts is less than 2%, especially less than 0.6%, by weight. A convenient way of determining when the salt content has been reduced to the desired level is by testing the electrical conductivity of the used wash water, for example with a Chemtrix Type 700 conductivity meter. Using this method washing is preferably continued until the conductivity of the wash water after use is no more than 140, more preferably no more than 60, micromhos/cm higher than the conductivity of the wash water prior to use.

The presscake is combined with additional water in an amount such that the dye content of the resulting mixture is in the range about 8 to 40%, preferably 10 to 35%, more preferably 15–35% by weight. The particular dispersing agents used to make the dye dispersions are not critical. Good results have been obtained using various anionic and non-ionic surface active compounds and mixtures thereof, such as sodium lignin sulfonates sold under the tradenames Vanisperse CB, Reax® 85A and Reax® PC 946, sodium salts of polymerized alkyl naphthalene sulfonic acids (e.g. Tamol® SN) and mixtures of glycols. The amount of dispersing agent will depend to some extent on the particular dyestuff being dispersed and is well within the skill of the art to determine. Good results have been obtained using 5 to 20% dispersing agent based on the total weight of the dispersion. Other additives, such as a biocide, may also be included in the dispersion. The components of the dispersion are preferably stirred together and the resulting mixture is milled until a good dispersion is obtained in which the particles of dispersed sulfur dye are preferably of a size in the range 0.1 to 5 microns, more preferably 0.3 to 1.5 microns as measured with a Microtrac® Particle-Size Analyzer (Leeds-Northrup).

The amount of dye dispersion used to make the dyeing liquor or printing paste will vary, depending on the dye content of the dispersion and the depth of shade desired. Usually, about 15 to 165 grams of dye dispersion are added per liter of dyeing liquor.

The process of the present invention is especially suitable for dyeing cellulose-containing textile material with sulfur dyes which require a relatively low reduction potential for their solubilization, e.g. oxidized sulfur dyes which can be reduced with glucose and sodium hydroxide at concentrations within the ranges specified above within 60 seconds at 102° C. Representative of such dyes are C.I. Sulfur Black 1 (Const. No. 53185), C.I. Sulfur Black 2 (Const. No. 53195), C.I. Sulfur Black 18, C.I. Sulfur Green 2 (Const. No. 53571), C.I. Sulfur Green 36, C.I. Sulfur Blue 7 (Const. No. 53440), C.I. Sulfur Blue 13 (Const. No. 53450), C.I. Sulfur Blue 43 (Const. No. 53630), C.I. Sulfur Red 10 (Const. No. 53228), C.I. Sulfur Red 14, C.I. Sulfur Brown 37 and C.I. Sulfur Yellow 22.

Because the dyes are in the water-insoluble oxidized state when they are applied to the substrate according to the method of this invention, they are not substantive to the cellulosic fibers and do not immediately strike on the fibers but rather have an opportunity to become evenly distributed before being rendered substantive by the heating step. As a result, problems such as side-center cross-shading and tailing are avoided.

The invention will be illustrated by the following examples in which parts and percentages are by weight.

EXAMPLE 1

A mixture of 250 parts of a crude thionation mass of the green leuco sulfur dye prepared according to Example 1 of U.S. Pat. No. 3,338,918 and 488 parts water is aerated at 88° C. for 2 hours, cooled to 45° C. and filtered. The filter cake is washed with tap water having a conductivity of 65 micromhos/cm until the wash liquid is clear and has a conductivity of 110 micromhos/cm. Fifty-five parts of a presscake having a solids content of 43.2% is obtained.

Into a laboratory ball mill are charged:

13.9 parts of the above-prepared sulfur dye presscake, 2.4 parts sodium lignin sulfonate (Vanisperse CB), 1.5 parts sodium salt of polymerized alkyl naphthalene sulfonic acid (Tamol® SN), 0.6 part of a mixture of diethylene glycol and 2,4,7,9-tetramethyl-5-decyne-4,6-diol (Surfynol® 104E), 0.1 part sodium salt of chlorinated bis-phenol (Givgard G4-40) and 11.0 parts water.

The resulting mixture is stirred and then milled for 24 hours to give 28.5 parts of a dispersion of the above-prepared sulfur dye.

Five parts of the above-prepared dye dispersion and 50 parts water are stirred together until a uniform mixture is obtained. To this mixture are added 12 parts glucose, 12 parts aqueous sodium hydroxide (50%), 10 parts water and 0.5 part sodium salt of ethylhexanol phosphate ester. The resulting mixture is stirred for 5 minutes and then diluted to 133 parts with additional water.

The above-prepared dyeing liquor is heated to 43° C. and poured into the dye pan of an Aztec® laboratory padder-steamer, which has a non-pressurized steamer. Pre-bleached cotton twill cloth is padded through the dyeing solution to a wet pick-up of 70–80%, steamed for 60 seconds at 101–103° C and then rinsed with warm tap water.

An oxidizing solution is prepared by adding 7.5 g hydrogen peroxide (35% solution) and 7.5 g glacial acetic acid to sufficient water to give a total volume of one liter. This solution is heated to 60° C and the above-dyed substrate is added and the solution is stirred for 30 seconds. The substrate is then rinsed with warm tap water until clean and then dried. A level green dyeing is obtained.

EXAMPLE 2

To 402 parts of a crude thionation mass of C.I. Sulfur Blue 13 (C.I. Const. No. 53450) are added 1354 parts water. The resulting mixture is aerated at 90° C. for 11 hours until all of the sulfides are completely oxidized (as determined by a reduction potential measurement of 0). The pH of the resulting slurry is lowered to pH 5.6 by the addition of 7.5 parts sulfuric acid (70%) and it is then filtered. The filter cake is washed with tap water having a conductivity of 65 micromhos/cm until the conductivity of the wash water is less than 110 micromhos/cm, yielding 285 parts of filter cake having a solids content of 27.5%.

Into a ball mill are charged:

203 parts of the above-prepared sulfur dye filter cake 15 parts sodium lignin sulfonate (Vanisperse CB), 12 parts sodium salt of polymerized alkyl naphthalene sulphonic acid (Tamol®SN), 1 part 6-acetoxy-2,4,dimethyl-M-dioxane (GIVGARD DXN)

and 63 parts water.

The resulting mixture is milled with marbles for 24 hours and then with sand for 24 hours until the particle size is in the range 1-5 microns and then separated from the sand.

An aqueous dye liquor is prepared containing, per 1000 parts water, 30 parts of the dye paste prepared as described above and 15 parts of an alginate-type antimigrant. Bleached, mercerized cotton twill is padded with said liquor at 60° C. to a wet pick-up of 60 to 70%, pre-dried in an infra-red drier (Forstoria) to remove 30% of the moisture and then dried in an oven at 82–99° C. until completely dry. Using a padder-steamer manufactured by Greenville Steel Textile Machinery Corp. (Serial No. 39377) the material is next padded to a wet pick-up of 100% with an aqueous liquor at room temperature containing, per 1000 parts water, 60 parts aqueous sodium hydroxide (50%) and 120 parts dextrose and then steamed for 60 seconds at 103° C in the non-pressurized steaming chamber of said padder-steamer. The material is then washed with water at ambient temperature and subjected to a combined oxidation-scouring for 30 seconds at 65° C. in an aqueous bath containing, per 1000 parts water, 7.5 parts acetic acid (56%), 7.5 parts vanadium pentoxide-catalyzed sodium bromate and 3.75 parts commercial nonionic scouring agent (Sodyeco® Scour TR). After further washing with water at 65–70° C. and then with water at ambient temperature, a level blue dyeing is obtained which is characterized by its excellent brightness.

What is claimed is:

1. A method for the continuous dyeing or printing of a cellulose-containing textile substrate which comprises continuously applying to said substrate ane aqueous dispersion of a sulfur dye and, either simultaneous therewith or subsequently thereto, continuously applying to said substrate a reducing sugar together with alkali and then heating the thus-treated substrate with steam to a temperature of 98° C. to 105° C. to effect reduction of the dye thereon, said method being effected using conventional continuous dyeing or printing equipment wherein the heating is effected in a non-pressurized zone.

2. A method according to claim 1 wherein the sulfur dye is applied to the substrate by padding.

3. A method according to claim 1 wherein the aqueous dispersion of the sulfur dye contains the reducing sugar and alkali.

4. A method according to claim 1 which comprises applying to the substrate the aqueous dispersion of the sulfur dye and subsequently applying to the substrate a solution of the reducing sugar in aqueous alkali.

5. A method according to claim 1 wherein the reducing sugar is glucose.

6. A method according to claim 1 wherein the sulfur dye is free of inorganic sulfides.

7. A method according to claim 1 wherein the sulfur dye is selected from the group consisting of C.I. Sulfur Blacks 1, 2 and 18, C.I. Sulfur Greens 2 and 36, C.I. Sulfur Blues 7, 13 and 43, C.I. Sulfur Reds 10 and 14, C.I. Sulfur Brown 37 and C.I. Sulfur Yellow 22.

8. A method according to claim 3 wherein the reducing sugar is the sole reducing agent added to the aqueous dispersion of the sulfur dye.

9. A method according to claim 4 wherein the reducing sugar is the sole reducing agent added to the aqueous alkali.

10. A cellulosic textile substrate dyed by the method of claim 1.

11. A method according to claim 1 wherein the sulfur dye has a polysulfur content no greater than 7% by weight, based on the dry weight of the dye.

12. A method according to claim 1 wherein the sulfur dye has a polysulfur content in the range 0 to 3% by weight, based on the dry weight of the dye.

13. A method according to claim 1 wherein the sulfur dye is one which is obtained from a presscake which has been washed with water until the content of inorganic salts is less than 2% by weight, based on the weight of solids int eh presscake.

14. A method according to claim 1 wherein the sulfur dye is one which can be reduced with glucose and sodium hydroxide at concentrations in the range 30 to 135 g/l and 8 to 70 g/l, respectively, within 60 seconds at 102° C.

15. A method according to claim 1 wherein the heating of the substrate is effected at 100 to 103° C. for 40 to 110 seconds.

16. A method according to claim 3 wherein the heating of the substrate is effected at 100 to 103° C. for 40 to 110 seconds.

17. A method according to claim 3 wherein the aqueous dispersion of the sulfur dye is applied to the substrate at a temperature in the range 20 to 60° C.

18. A method according to claim 3 wherein the sulfur dye is one which can be reduced with glucose and sodium hydroxide at concentrations in the range 30 to 135 g/l and 8 to 70 g/l, respectively, within 60 seconds at 102° C.

19. A method according to claim 3 wherein the substrate is in the form of yarn or woven or knitted fabric.

20. A method according to claim 4 wherein the sulfur dye is one which can be reduced with glucose and sodium hydroxide at concentrations in the range 30 to 135 g/l and 8 to 70 g/l, respectively, within 60 seconds at 102° C.

21. A method according to claim 12 wherein the aqueous dispersion of the sulfur dye is applied to the substrate at a temperature in the range 20 to 60° C.

22. A method according to claim 12 wherein the sulfur dye is one which is obtained from a presscake which has been washed with water until the content of inorganic salts is less than 2% by weight, based on the weight of solids in the presscake.

23. A method according to claim 14 wherein the sulfur dye is applied to the substrate by padding.

24. A method according to claim 18 wherein the sulfur dye is applied to the substrate by padding.

25. A method according to claim 23 wherein the sulfur dye is selected from the group consisting of C.I. Sulfur Blacks 1, 2 and 18, C.I. Sulfur Greens 2 and 36, C.I. Sulfur Blues 7, 13 and 43, C.I. Sulfur Reds 10 and 14, C.I. Sulfur Brown 37 and C.I. Sulfur Yellow 22.

26. A method according to claim 24 wherein the sulfur dye is selected from the group consisting of C.I. Sulfur Blacks 1, 2 and 18, C.I. Sulfur Greens 2 and 36, C.I. Sulfur Blues 7, 13 and 43, C.I. Sulfur Reds 10 and 14, C.I. Sulfur Brown 37 and C.I. Sulfur Yellow 22.

* * * * *